United States Patent [19]

Kooy et al.

[11] 4,430,012

[45] Feb. 7, 1984

[54] PAPER GUIDE FOR LINE PRINTER

[75] Inventors: Wayne J. Kooy, Galein; Horst M. Krenz, St. Joseph; Lawrence C. Unger, Benton Harbor, all of Mich.

[73] Assignee: Zenith Radio Corporation, Glenview, Ill.

[21] Appl. No.: 471,767

[22] Filed: Mar. 3, 1983

Related U.S. Application Data

[63] Continuation of Ser. No. 251,413, Apr. 6, 1981.

[51] Int. Cl.[3] ..... B41J 11/30

[52] U.S. Cl. ..... 400/616.1; 400/619; 400/646; 226/74; 226/199; 242/76

[58] Field of Search ..... 400/616.1, 616.3, 578, 400/579, 619, 646, 647, 647.1; 101/DIG. 21, 181, 228; 226/74, 75, 199; 242/76

[56] References Cited

U.S. PATENT DOCUMENTS

| | | | |
|---|---|---|---|
| 1,638,560 | 8/1927 | Beveridge | 226/199 X |
| 2,764,087 | 9/1956 | Stobb | 101/181 |
| 3,106,365 | 10/1963 | Karr | 226/199 X |
| 3,970,193 | 7/1976 | Robinson et al. | 400/124 |
| 4,129,239 | 12/1978 | Hubbard | 226/75 |

OTHER PUBLICATIONS

IBM Technical Disclosure Bulletin "Controlled Path for Continuous Form Feeding 38 vol. 1, No. 6, Apr. 1959, p. 3 by Reed.

*Primary Examiner*—Edgar S. Burr
*Assistant Examiner*—Charles A. Pearson

[57] ABSTRACT

A curvilinear, semi-rigid paper guide for a bi-directional line printer mounted on a platen which provides a surface that bears against the moving print head as the print medium passes between the print head and the paper guide is disclosed. By adjusting the curvature of the paper guide, differences in the distances between adjacent drive sprockets of upper and lower print medium drive mechanisms may be compensated for thus ensuring the printing of straight, parallel and unskewed character lines. In addition, the present invention may be used in a line printer having a single print medium drive mechanism to compensate for nonlinearities in and non-parallelism between the surface of the platen and print head movement.

13 Claims, 4 Drawing Figures

PAPER GUIDE FOR LINE PRINTER

This is a continuation of application Ser. No. 251,413, filed Apr. 6, 1981.

BACKGROUND OF THE INVENTION

This invention relates generally to line printers, and particularly relates to a paper guide for use in a high speed line printer.

In a commonly used high speed printing device, a character print head is transported parallel to a stationary platen with its printing elements selectively activated in a transverse direction toward the platen. The print medium is positioned between the moving print head and the platen with the impact of the moving print head on an inked ribbon in contact with the print medium thus forming the printed characters.

The print medium, which is generally paper, is provided to the high speed printer from a paper supply which generally feeds a continuous roll of paper in which individual sheets are distinguished by perforated lines. This print medium feed configuration avoids the necessity of providing individual print medium sheets to the printer. In a bi-directional line printer the print medium is generally moved by means of a lower drive mechanism located between the paper supply and the print head and an upper drive mechanism which pulls the print medium past the print head toward a print medium storage location. The print medium lower and upper drive mechanisms generally include a pair of sprockets, or cog wheels, each having a plurality of teeth around its periphery for engagement with a linear array of apertures positioned at each edge of the continuous print medium strip. In a line printer in which the print medium is moved only in one direction, only an upper drive mechanism is required to pull the print medium past the transversely moving print head.

It is important in such a configuration that the paired lower and upper drive mechanism sprockets be precisely aligned with respect to one another. If this precise alignment is absent, the print medium will be transported in a direction which is not perpendicular to the movement of the print head resulting in skewed character lines. In addition, irregularities in sprocket teeth spacing or aperture spacing on either edge of the print medium will result in non-linear character arrays or character lines angled with respect to the transverse axis of the print medium. Even with precise alignment of input and take-up sprocket assemblies, misalignment of the stationary platen along its length relative to the moving print head will result in a non-linear, irregular array of printed characters applied to the print medium by the rapidly moving print head. Still another source of irregular character arrays produced by a high speed line printer is related to environmental factors such as changes in humidity which affect physical properties of a paper printer medium, e.g., increased humidity causes paper under tension to stretch. The prior art discloses various approaches for improving line printer performance in this area.

One approach for accurately positioning the print medium along a platen relative to the moving print head is disclosed in U.S. Pat. No. 4,179,023 to DeBoo et al wherein is disclosed a paper guide which extends around the platen and includes a flexible extension which bears against the front of the moving print mechanism in guiding the paper into the small gap between the print head and the platen. The flexible final guide extends up the side of the platen adjacent the printing mechanism and bears against the printing head so as to be flexibly deflected by the print head as the print head moves across the front of the platen. The leading edge of the print medium is therefore less likely to catch on the ribbon or get caught on the edge of the paper-exit opening of the cabinet in which the printing machine is located. This invention is designed to operate with a revolving platen and relates to the input, or feeding, of the print medium to the narrow space between the print head and the platen. U.S. Pat. No. 4,242,006 to Kondur relates to an improved print medium advancement mechanism which includes a ratchet wheel mechanically coupled to print media support sprockets. The ratchet wheel provides rotational motion to a shaft coupled to the sprockets in response to an electrical signal from the printer thereby moving the print media incrementally. The print medium is held in a relatively fixed orientation relative to the revolving sprockets by means of a media guide 20 which is mechanically coupled to the disc-shaped hub 18 of sprocket 16 so that the print medium 8 is disposed between it and the cylindrical sidewall of sprocket 16. The medium guides 20 therefore ensure that the print medium will remain in contact with the sprocket drive wheels during high speed operation and that print medium movement will be regular and continuous. In addition, guides 20 also allow for the smooth tracking of the print medium in front of platen **11*a* in ensuring the impact of print head 13 upon a flattened print medium. Paper guides 20, however, do not compensate for misalignment of sprockets 16 relative to platen 11*a* and print head 13. Nor do sprockets 16 allow for improper alignment between themselves or for misalignment between sprockets 16** and the sprockets of a print medium input drive if present in the high speed printer.

Another approach to print medium adjustment in a line printer involves the use of a pulley-clutch assembly coupled to rotatable sprockets the teeth of which engage the apertures on each edge of the print medium. The push-type clutch assembly allows the serrations of the pulley to be disengaged from the pulley drive train permitting the pulley to be manually rotated in adjusting print medium tension. Once the desired tension has been applied to the print medium, the push-type clutch is then released and the rotatable sprockets coupled to pulleys which, in turn, are coupled to the pulley drive train move the print medium as required. The precision with which print medium tension is adjusted in this manner is limited by the spacing between adjacent serrations of each pulley.

The present invention is intended to avoid the aforementioned print medium misalignment problems in a high speed printer which cause the skewed orientation of character lines and non-linear character printing. These problems are avoided by means of an adjustable, precisely positioned means for accurately adjusting print medium path length between the upper and lower drive sprockets in a bi-directional printer and between the upper drive sprockets and the line defined by the translational motion of the print head in a single direction printer.

OBJECTS OF THE INVENTION

Accordingly, it is an object of the present invention to provide an improved print medium guide for a line printer.

It is another object of the present invention to provide an impact printer arrangement including means for compensating for printer characteristics which result in the displacement of printed characters.

It is another object of the present invention to provide an improved paper guide for a high speed line printer capable of compensating for variations in print medium drive mechanism dimensions.

Still another object of the present invention is to provide an improved paper guide for a high speed line printer for producing straight, parallel character lines.

BRIEF DESCRIPTION OF THE DRAWINGS

The appended claims set forth those novel features believed characteristic of the invention. However, the invention itself, as well as further objects and advantages thereof, will best be understood by reference to the following detailed description of a preferred embodiment taken in conjunction with the the accompanying drawings, wherein like reference characters indicate like or corresponding parts, in which:

DESCRIPTION OF THE PREFERRED EMBODIMENTS

Figure 1:
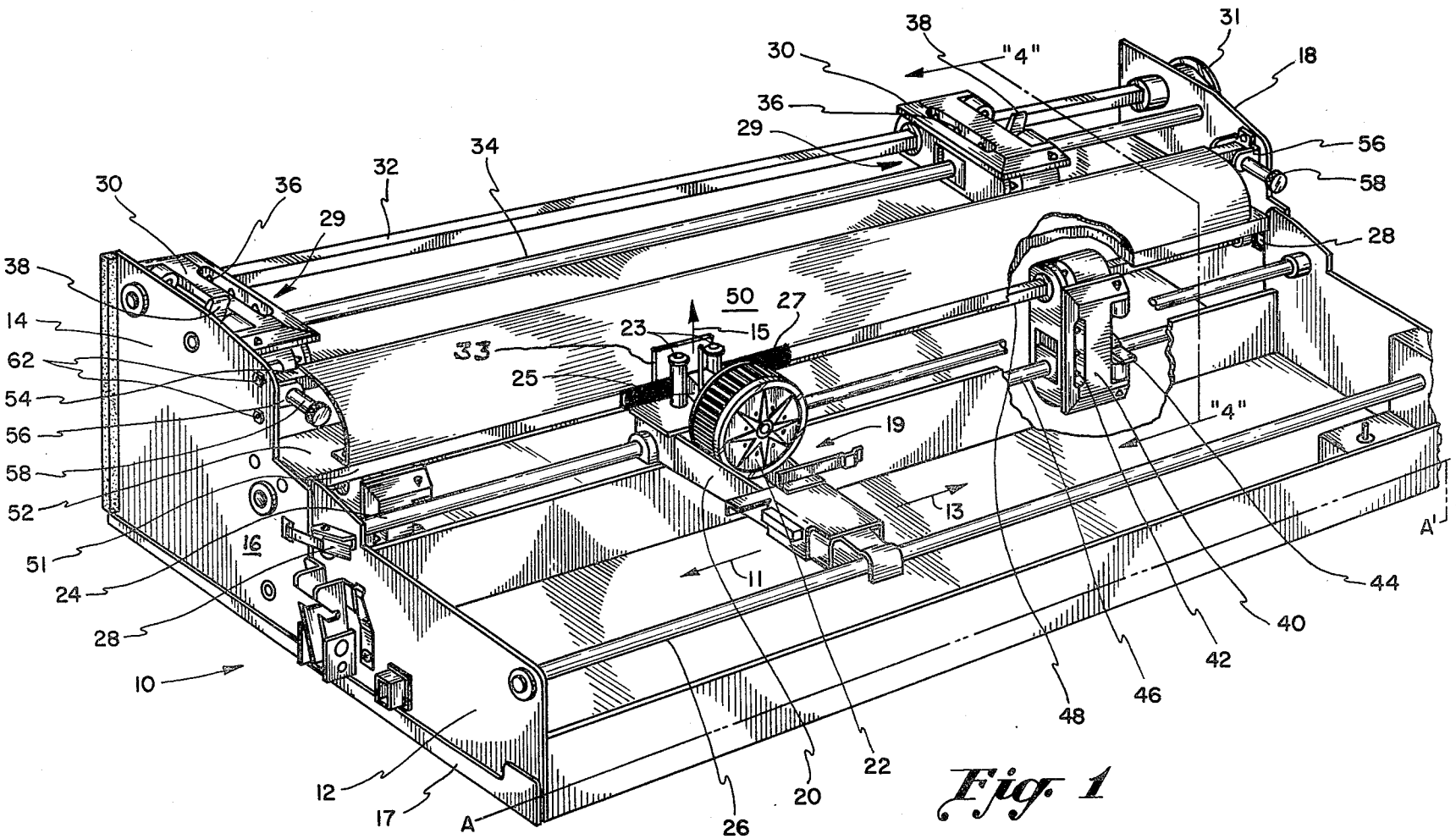
FIG. 1 is a perspective, partially cut-away view of a high speed line printer embodying a paper guide in accodance with the present invention.

Referring to FIG. 1, there is shown a typical high speed line printer 10 which incorporates the paper guide 50 of the present invention. Line printer 10 generally includes a printer assembly 12, which incorporates a movable print head and guide assembly 19, and paper drive/guide assembly 14 by means of which the print medium is moved at regular time intervals across the front of print head and guide assembly 19 and in the direction of arrow 15. Print head and guide assembly 19 is supported for transport adjacent paper guide 50 on a track defined by a forward print head support bar 24 and a rear print head support bar 26 both of which are machined, smoothly rounded rods. Support bars 24 and 26 are spaced in a transverse direction from paper guide 50 and extend in a direction generally parallel to the longitudinal axis of paper guide 50. Positioned between print head and guide assembly 19 and paper guide 50 are a print medium comprising an edge perforated, elongated sheet, typically of paper, (not shown) and an inked print ribbon 27. Print head and guide assembly 19 generally includes a print head carriage 20 which is mounted on forward and rear support bars 24 and 26. Also included in print head and guide assembly 19 is a print head 22 by means of which character elements impact the print medium through inked ribbon 27 thereby imposing the desired character on the print medium. Shown in FIG. 1 is a standard impact printer print head 22 which includes a vertically aligned array of print wires (not shown). Each of the print wires of the array is selectively, electro-magnetically energized by an associated solenoid winding, also not illustrated. A print wire advances in a transverse direction with respect to the longitudinal axis of paper guide 50 and a leading segment of the print wire impacts inked ribbon 27, the print medium and the front horizontal surface 51 of lower paper guide support bar 52. Impact causes printing of an inked area corresponding to a face of the forward wire segment. Paper guide lower support bar 52 thus also serves as a platen in the character printing process. The selectively energized print wires produce an array of dots representing the selected character. As print head 22 is transversely transported along platen 52, the array of print wires are selectively energized forming one or more dots at a given location thus forming a matrix character. While the present invention is described in terms of its use with an impact printer of the dot matrix type, any of the more conventional impact printers could be used equally as well in combination with an inked print ribbon in the present invention.

Print head and guide assembly 19 is alternatively transported laterally along forward support bar 24 and rear support bar 26 in directions represented by arrows 11 and 13. This motion causes print head and guide assembly 19 to move parallel to the longitudinal axis of paper guide 50 and platen 52 and is accomplished by means of a gear belt, drive pulley, idler pulley, and a means for rotating the drive pulley, none of which are shown in FIG. 1 as the print head drive assembly is of conventional design. Supported on print head carriage 20 is print head 22 in which is contained the vertically aligned array of print wires previously discussed. An inked print ribbon cartridge (not shown) of conventional design is mounted either upon print head carriage 20 or upon printer assembly 12. The inked print ribbon is moved as the print head carriage 20 is transported. This cartridge provides the inked print ribbon 27 adjacent the forward surface of print head 22 and between this unit and the forward surface 51 of platen, or lower paper guide support bar, 52. The inked print ribbon 27 is precisely positioned between print head 22 and lower paper guide support bar 52 by means of ribbon guide posts 23 which provide proper tensioning of the drag for the inked print ribbon which moves in a direction transverse to the longitudinal axes of ribbon guide posts 23. Also included in a preferred embodiment of the present invention is a stainless steel shield (33) positioned between lower paper guide support bar 52 and inked print ribbon 27 which is immediately adjacent to the forward portion 25 of print head 22. This stainless steel shield includes an aperture (not shown) through which the impact printer contacts inked print ribbon 27 and, in turn, the print medium. The stainless steel shield 33 provides for the displacement of the inked print ribbon from the print medium during non-use periods and avoids the smearing of wet ink following start-up of the line printer. This ink smearing is believed to be due to the capillary action between the print medium and the inked print ribbon.

Printer assembly 12 is coupled to first and second sidewalls 16 and 18 of paper drive/guide assembly 14 by means of releasable latches 28 located on each side of printer assembly 12. This permits printer assembly 12 to pivot around the axis designated by A-A' where it is affixed to side panels 17. By thus unlatching printer assembly 12 from paper drive/guide assembly 14 the two sub-units may be separated for improved accessibility for repair work, maintainance, paper path clearing, or paper supply loading.

Paper drive/guide assembly 14 includes first and second sidewalls 16 and 18 from which various components involved in the operation of line printer 10 are supported. Connecting first and second sidewalls 16 and 18 and supporting two print medium upper drive mechanisms 29 are machine rounded upper drive mechanism support bar 34 and upper drive mechanism drive bar 32. Upper drive mechanisms 29 may be moved manually along upper drive mechanism support bar 34 and drive bar 32 as required by the width of the print medium. Each upper drive mechanism includes a spring-loaded cover 30, a position locking latch 38, and a flexible track (not shown) upon the outer surface of which are located a plurality of teeth 36.

In loading line printer 10 with a print medium each drive mechanism cover 30 is raised and the position of each upper drive mechanism 29 is adjusted along the drive mechanism drive bar 32 and support bar 34 so that the linear array of apertures along each edge of the print medium coincides with the position of drive mechanism teeth 36. When the teeth 36 on the upper surface of paper upper drive mechanism 29 engage the print medium by projecting through the edge-positioned print medium apertures, drive mechanism cover 30 is placed in the down, or horizontal, position and retained there by spring means (not shown) in upper drive mechanism 29. Drive mechanism position locking latch 38 is then moved so as to engage upper drive mechanism support bar 34 in locking each paper drive mechanism 29 in a stationary position along drive bar 32 and support bar 34. In this manner paper upper drive mechanisms 29 are able to continuously hold the print medium in a stationary position along paper guide 50 and in front of print head 22. The print medium is then stored in a conventional print medium storage device. The spiked drive belt (not shown) in each of upper drive mechanisms 29 is coupled to drive bar 32 which in turn, is rotated by means of drive capstan 31 which is coupled to a gear belt and electric motor driven pulley (not shown) in a conventional manner.

One of the lower drive mechanisms 39 is shown in the cut-away portion of FIG. 1. The two paper drive mechanisms 39 operate in a manner similar to the upper drive mechanisms 29 in that they include a cover 40, a flexible drive belt (not shown) having a plurality of teeth, or spikes, 42 on its outer periphery, and a position locking latch 44. As in the case of the upper drive mechanisms 29, the lower drive mechanisms 39 are mounted on a support bar 46 and a drive bar 48 which is coupled to flexible belt and spike assembly 42 for pulling the print medium having edge perforations from the print medium supply and providing it to the space between print head 22 and platen 52. The lower drive mechanisms 39 are moveable along support and drive bars 46 and 48. They may be locked in a stationary position along support bar 46 by means of position locking latch 44 with spring-loaded cover 40 placed in the position shown in FIG. 1 to ensure engagement of spikes, or teeth, 42 with the edge apertures, or perforations, of the print medium. The print medium is moved in a vertical direction by means of lower drive mechanisms 39 so as to pass between platen 52 and print head 22, passing across the width of platen 52 in an initially vertical and finally horizontal direction toward upper drive mechanisms 29. As in the case of upper drive mechanisms 29, when lower drive mechanism cover 40 is opened to a position perpendicular to the plane defined by support bar 46 and drive bar 44 the print medium may be released from engagement with the flexible belt and spike assembly 42 to permit the print medium to be manually removed from line printer 10.

Figure 2:
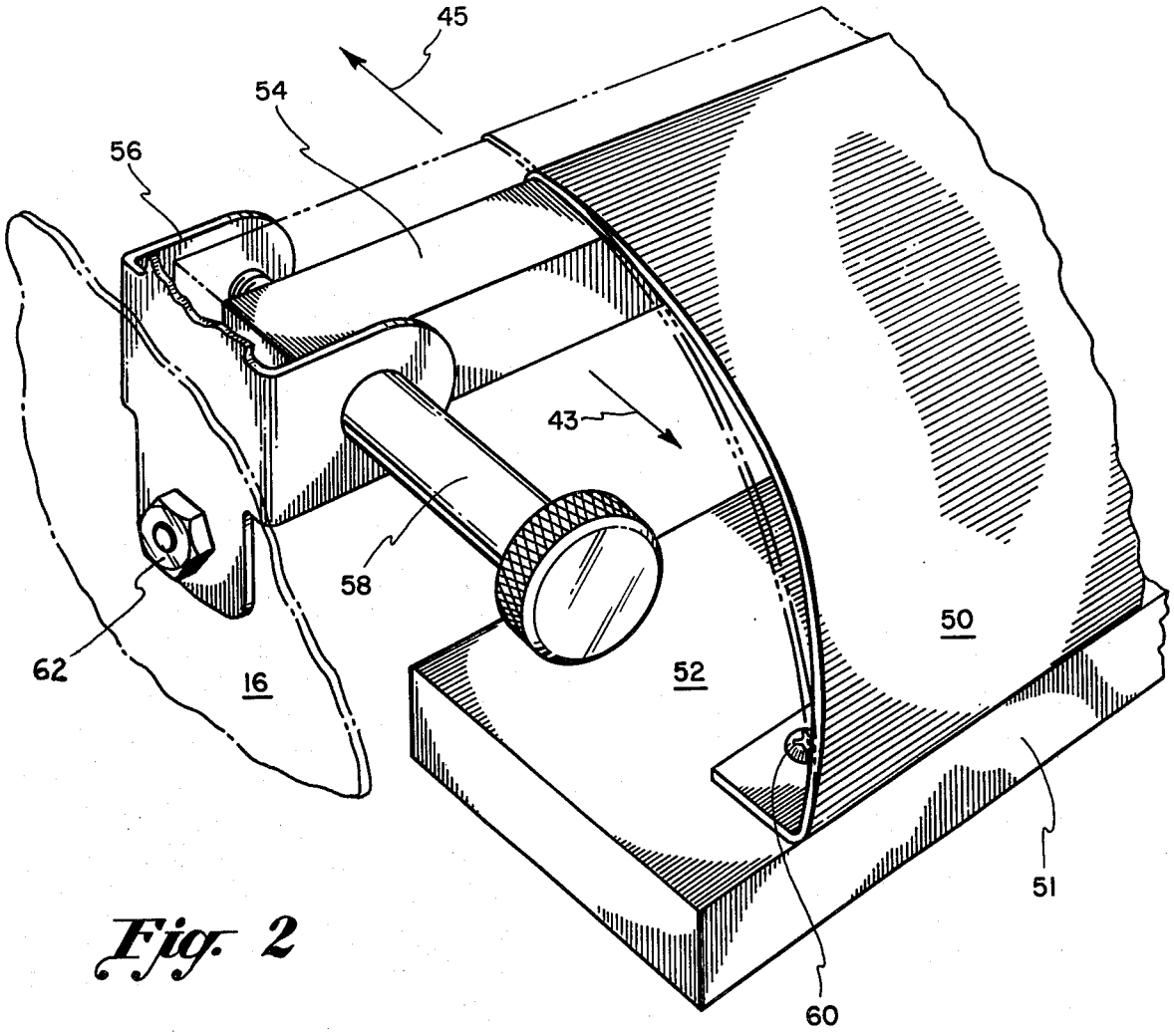
FIG. 2 is a perspective view of the paper guide and adjustment means of the present invention and shows how changes in the adjustment means produce changes in the position and shape of the paper guide.
Figure 3:
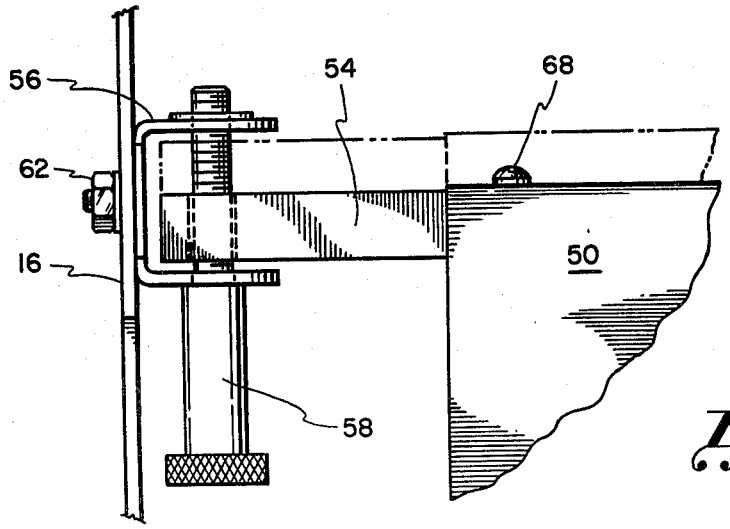
FIG. 3 is a top or plan view of the paper guide and adjustment means of the present invention and shows two of the various positions to which the paper guide may be adjusted.

Referring to FIGS. 2 and 3, in accordance with the present invention semi-rigid paper guide 50 is fabricated from sheet metal. The lower edge of paper guide 50 is connected to the upper surface of lower paper guide support bar, or platen, 52 by means of a plurality of screws 60 joining paper guide 50 to support bar 52 along the length of each of these members. As previously stated, the front surface 51 of platen 52 serves as the rigid backing for the print medium during the imprinting of characters thereon by print head 22. The upper edge of paper guide 50 is coupled to upper paper guide support bar 54 by means of a plurality of screws 68 along the length of paper guide 50. Upper paper guide support bar 54 is, in turn, connected to an adjustable screw control 58 which is mounted at each end to first and second sidewalls 16 and 18 by means of a pair of bracket assemblies 56. Bracket assemblies 56 are rigidly connected to the vertical sidewalls by means of a nut/-bolt combination 62.

With upper paper guide support bar 54 coupled to adjustable screw control 58, the rotation of adjustable screw control means 58 and the action of its threads upon bracket 56 will result in the movement of upper paper guide support bar 54 in the direction of arrow 43 if adjustable screw control is rotated in a counter-clockwise direction and in the direction of arrow 45 if adjustable screw control 58 is rotated in a clockwise direction. In this manner, horizontal translational motion may be imparted to upper paper guide support bar 54 resulting in a change in position of the upper edge of paper guide 50. An alternate position of support bar 54 and paper guide 50 is shown in FIGS. 2 and 3 by means of the dotted lines which indicate a position further displaced from print head 22. As upper paper guide support bar 54 is moved in either the direction indicated by arrow 43 or the direction indicated by arrow 45 the curvature of paper guide 50 is changed accordingly since the lower edge of paper guide 50 is fixedly mounted to platen 52. As the curvature of paper guide 50 is changed, the distance traversed by the print medium between lower and upper paper drive mechanisms 39 and 29, or the inter-drive mechanisms paper path length, will change accordingly. Thus, when upper paper guide support bar 54 is moved in the direction of arrow 43 the paper path length between adjacent drive mechanisms will be increased. Similarily, when upper paper guide support bar 54 is moved in the direction of arrow 45 the inter-drive mechanism paper path length will be decreased. By thus manipulating adjustable screw controls 58, upper paper guide support bar 54 may be displaced either entirely or either of its ends selectively so as to change the curvature of paper guide 50 thus altering the inter-drive mechanism paper path length. In this manner, the tension applied to the print medium by means of paper guide 50 may be precisely adjusted and controlled along the entire width of the print medium to provide for increased accuracy in the positioning and placement of the print medium with respect to print head 22. By thus carefully controlling the tension applied to the print medium, the precision and accuracy with which the printed characters are placed upon the print medium is substantially increased. The present invention thus eliminates such undesirable character printing features as non-linear character arrays caused by non-constant tension applied to the print medium, skewed character lines caused by print medium path differences between adjacent print medium drive mechanisms, and non-parallel printed character lines caused by the non-uniform application of positioning tension applied to the print medium across the paper guide. While the present invention will be particularly useful in a bi-directional high speed line printer having a set of upper and lower print medium drive mechanisms in compensating for print medium path differences between adjacent drive mechanisms, it also has application in a single print medium drive mechanism line printer capable of print medium motion in only one direction. In the latter case, the present invention permits nonlinearities in and non-parallelism between the surface of the platen and print head motion to be compensated for.

Figure 4:
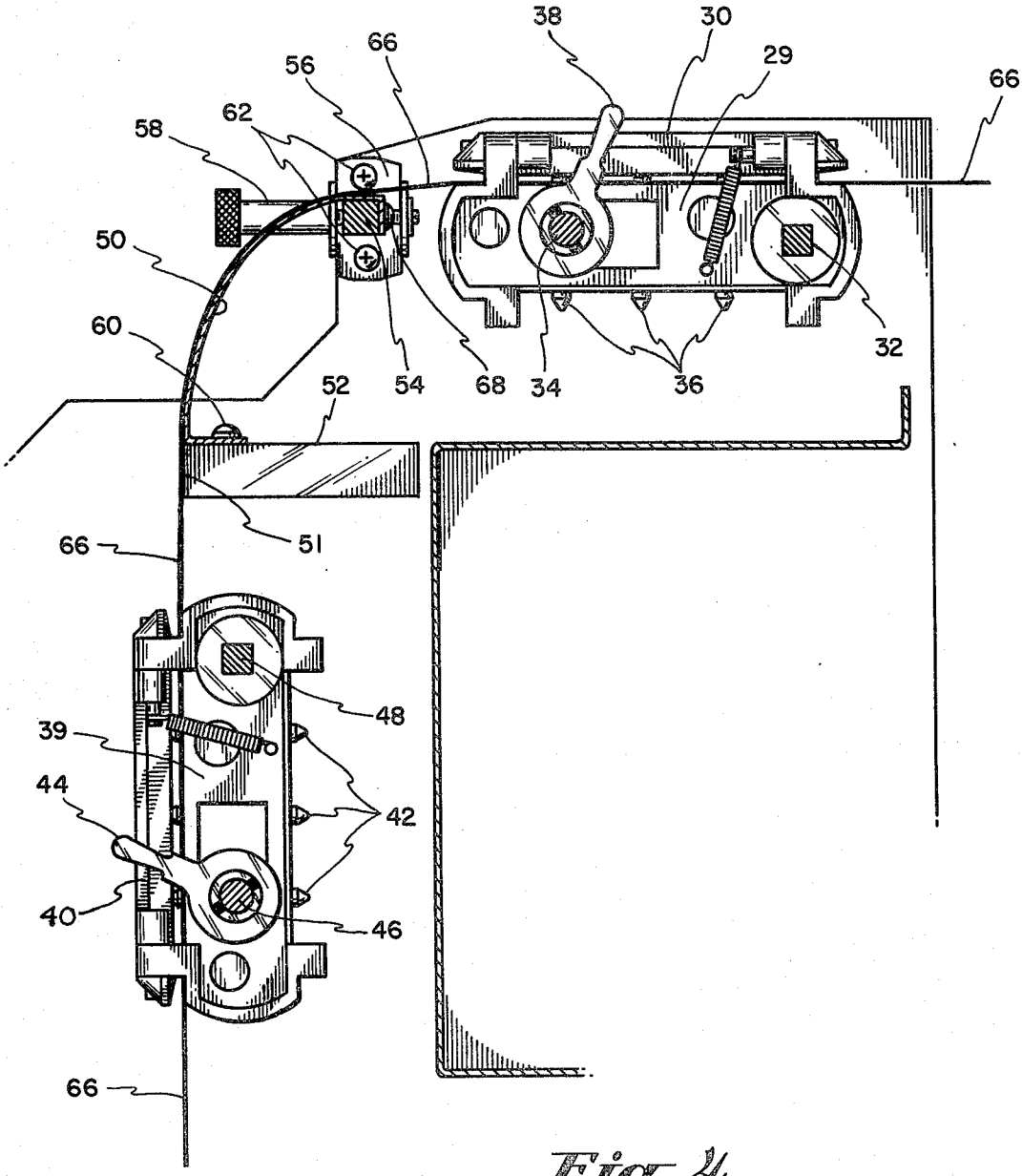
FIG. 4 is a cross-sectional view of the paper path, paper drive assembly of a bi-directional printer and the paper guide of the present invention.

FIG. 4 is a plan view in cross section taken along lines 4—4 of FIG. 1 and shows in greater detail the paper path through lower drive mechanism 39, upper drive mechanism 29, and along the upper surface of paper guide 50. From this figure it can readily be seen that by moving upper paper guide support bar 54 in a horizontal direction by means of adjustable screw control 58 the paper path length between the two sets of drive mechanisms may be precisely adjusted. In addition, since each screw control 58 may be independently adjusted the tension applied along the width of the print medium may be precisely adjusted to allow for differences between the inter-drive mechaism paper path distances of the respective upper and lower drive mechanism combinations. While the preferred embodiment of the present invention has been shown in terms of platen 52 also serving as the lower support bar for paper guide 50, the present invention is not limited to such a configuration. Indeed, paper guide 50 may be totally disconnected and separate from platen 52. The only requirement regarding the relative orientation of paper guide 50 and platen 52 to satisfy the present invention is that paper guide 50 be positioned along the print medium path between platen 52 and upper drive mechanism 29. Finally, it is to be noted that the present invention is also not limited to a configuration in which the moveable edge of paper guide 50 is positioned adjacent the space defined by platen 52 and print head 22. The present invention will operate equally as well if the moveable edge of paper guide 50 is proximally located with respect to upper drive mechanism 29 or with respect to platen 52.

There has thus been shown a paper guide for use in a high speed line printer which provides for the accurate adjustment of tension applied to the print medium for more accurate print character placement thereon.

While particular embodiments of the invention have been shown and described, it will be obvious to those skilled in the art that changes and modifications may be made without departing from the invention in its broader aspects and, therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A paper feeding and guide apparatus for use in a bi-directional line printer having a frame including first and second structural support means, a plurality of cross-members coupled between said first and second structural support means including a platen and a print head having a printing surface facing said platen and supported on a first cross-member and arranged to move in a path of travel along said first cross-member a permitted distance for printing on paper positioned between said platen and said print head and moving in a generally perpendicular direction to said print head direction of movement, said apparatus comprising:

first rotatable paper drive means located below said platen for providing paper in a generally upward direction between said platen and said print head;

second rotatable paper drive means for receiving said paper following the transport of said paper between said platen and said print head and for transporting said paper in a plane generally perpendicular to the direction of movement of the paper between said platen and said print head; and adjustable curved guide means positioned beneath and in contact with said paper between said platen and said second rotatable paper drive means and having a first lower end portion fixedly mounted to said platen, a second upper end portion, and third and fourth lateral end portions positioned intermediate said first and second end portions, wherein said first and second end portions form opposite, facing edges of said guide means and wherein said second upper end portion is adjustably mounted for movement in a direction parallel to the paper path thereat to said first and second structural support means by means of which the curvature at each lateral end portion of said guide means may be independently adjusted in adjusting the paper path length between the respective ends of said first and second rotatable paper drive means for precisely positioning the paper relative to said print head.

2. The apparatus of claim 1 wherein said adjustable guide means comprises a semi-rigid, arcuate surface, the second upper end portion of which is fixedly mounted to a second cross-member wherein the ends of said second cross-member are moveably connected to said first and second structural support means.

3. The apparatus of claim 2 wherein said adjustable guide means is comprised of flexible sheet metal.

4. The apparatus of claim 2 wherein said adjustable guide means further comprises bracket means coupled to said first and second structural support means and threaded means coupled to each of said bracket means and to each end of said second cross-member such that when said threaded means are rotated, said second cross-member and attached second upper end portion of said adjustable guide means may be precisely positioned.

5. The apparatus of claim 1 wherein each of said first and second rotatable paper drive means include a pair of separated drive sprockets coupled to a rotatable drive shaft, the ends of said rotatable drive shafts being connected to each of said first and second structural support members.

6. The apparatus of claim 5 wherein each of said drive sprockets includes a plurality of teeth located equidistant around its circumference for engaging a plurality of apertures located adjacent each lateral edge of said paper such that when said drive sprockets are rotated said paper is moved in response thereto.

7. The apparatus of claim 6 further including movable restraining means adjacent to each of said drive sprockets for maintaining the insertion of said drive sprocket teeth in said apertures in the paper while said drive sprockets are rotating during printing.

8. A paper feeding and guide apparatus for use in a bi-directional line printer having a frame including first and second structural support means, a plurality of cross-members coupled between said first and second structural support means including a platen and a print head having a printing surface facing said platen and supported on a first cross-member and arranged to move in a path of travel along said first cross-member a permitted distance for printing on paper positioned between said platen and said print head and moving in a generally perpendicular direction to said print head direction of movement, said apparatus comprising:

first rotatable paper drive means located below said platen for providing paper in a generally upward direction between said platen and said print head;

second rotatable paper drive means for receiving said paper following the transport of said paper between said platen and said print head and for transporting said paper in a plane generally perpendicular to the direction of movement of the paper between said platen and said print head, said first and second rotatable paper drive means each including a pair of separated drive sprockets each having a plurality of teeth located equidistant around its circumference for engaging a plurality of apertures located adjacent each lateral edge of said paper and coupled to a rotatable drive shaft wherein the ends of said rotatable drive shafts are connected to each of said first and second structural support members; and semi-rigid, arcuate, adjustable guide means positioned beneath and in contact with said paper between said platen and said second rotatable paper drive means and having a first lower end portion fixedly mounted to said platen, a second upper end portion, and third and fourth lateral end portions positioned intermediate said first and second end portions, wherein said first and second end portions form opposite, facing edges of said guide means and wherein said second upper end portion is fixedly mounted to a second cross-member wherein the ends of said second cross-member are moveably connected for movement in a direction parallel to the paper path thereat to said first and second structural support means by means of bracket means in combination with threaded means such that when said threaded means are rotated the curvature of the respective lateral end portions of said guide means may be independently adjusted in adjusting the paper path length between the respective drive sprockets of said first and second rotatable paper drive means for precisely positioning the paper relative to said print head.

9. A paper feeding and guide apparatus for use in a bi-directional line printer having a frame including first and second structural support means, a plurality of cross-members coupled between said first and second structural support means including a platen and a print head having a printing surface facing said platen and supported on a first cross-member and arranged to move in a path of travel along said first cross-member a permitted distance for printing on paper positioned between said platen and said print head and moving in a generally perpendicular direction to said print head direction of movement, said apparatus comprising:

rotatable paper drive means for receiving said paper following the transport of said paper between said platen and said print head and for transporting said paper in a plane generally perpendicular to the direction of movement of the paper between said platen and said print head and in a direction away from said print head; and adjustable curved guide means positioned beneath and in contact with said paper between said platen and said rotatable paper drive means and having a first lower end portion fixedly mounted to said platen, a second upper end portion, and third and fourth lateral end portions positioned intermediate said first and second end portions, wherein said first and second end portions form opposite, facing edges of said guide means and wherein said second upper end portion is adjustably mounted for movement in a direction parallel to the paper path thereat to said first and second structural support means by means of which the curvature of the respective lateral end portions of said guide means may be independently adjusted in adjusting the paper path length between the respective ends of said rotatable paper drive means and said platen for precisely positioning the paper relative to said print head.

10. A paper feeding and guide apparatus for use in a line printer having a frame including first and second structural support means, a plurality of cross-members coupled between said first and second structural support means including a platen and a print head having a printing surface facing said platen and supported on a first cross-member and arranged to move in a path of travel along said first cross-member a permitted distance for printing on paper positioned between said platen and said print head and moving in a generally perpendicular direction to said print head direction of movement, said apparatus comprising:

rotatable paper drive means for receiving said paper following the transport of said paper between said platen and said print head and for transporting said paper in a plane generally perpendicular to the direction of movement of the paper between said platen and said print head, said rotatable paper drive means including a pair of separated drive sprockets each having a plurality of teeth located equidistant around its circumference for engaging a plurality of apertures located adjacent each lateral edge of said paper coupled to a rotatable drive shaft wherein the ends of said rotatable drive shafts are connected to each of said first and second structural support members; and semi-rigid, arcuate, adjustable guide means positioned beneath and in contact with said paper between said platen and said rotatable paper drive means and having a first lower end portion fixedly mounted to said platen, a second upper end portion, and third and fourth lateral end portions positioned intermediate said first and second end portions, wherein said first and second end portions form opposite, facing edges of said guide means and wherein said second upper end portion is fixedly mounted to a second cross-member wherein the ends of said second cross-member are moveably connected for movement in a direction parallel to the paper path thereat to said first and second structural support means by means of bracket means in combination with threaded means such that when said threaded means are rotated the curvature of the respective lateral end portions of said guide means may be independently adjusted in adjusting the paper path length between the respective ends of said rotatable paper drive means and said platen for precisely positioning the paper relative to said print head.

11. A paper feeding and guide apparatus for use in a bi-directional line printer having a frame including first and second structural support means, a plurality of cross-members coupled between said first and second structural support means including a platen and a print head having a printing surface said platen and supported on a first cross-member and arranged to move in a path of travel along said first cross-member a permitted distance for printing on paper positioned between said platen and said print head and moving in a generally perpendicular direction to said print head direction of movement, said apparatus comprising:

first rotatable paper drive means located below said platen for providing paper in a generally upward direction between said platen and said print head;

second rotatable paper drive means for receiving said paper following the transport of said paper between said platen and said print head and for transporting said paper in a plane generally perpendicular to the direction of movement of the paper between said platen and said print head; and adjustable curved guide means positioned beneath and in contact with said paper between said platen and said second rotatable paper drive means and having a first lower end portion fixedly mounted to said first and second structural support means, a second upper end portion, and third and fourth lateral end portions positioned intermediate said first and second end portions, wherein said first and second end portions form opposite, facing edges of said guide means and wherein said second upper end portion is moveably mounted for movement in a direction parallel to the paper path thereat to said first and second structural support means by means of which the curvature of the respective lateral end portions of said guide means adjacent said first and second structural support means may be independently adjusted in adjusting the paper path length between the respective ends of said first and second rotatable paper drive means for precisely positioning the paper relative to said print head.

12. A paper feeding and guide apparatus for use in a line printer having a frame including first and second structural support means, a plurality of cross-members coupled between said first and second structural support means including a platen and a print head having a printing surface facing said platen and supported on a first cross-member and arranged to move in a path of travel along said first cross-member a permitted distance for printing on paper positioned between said platen and said print head and moving in a generally perpendicular direction to said print head direction of movement, said apparatus comprising:

rotatable paper drive means for receiving said paper following the transport of said paper between said platen and said print head and for transporting said paper in a plane generally perpendicular to the direction of movement of the paper between said platen and said print head; and adjustable curved guide means positioned beneath and in contact with said paper between said platen and said rotatable paper drive means and having a first lower end portion fixedly mounted to said first and second structural support means, a second upper end portion, and third and fourth lateral end portions positioned intermediate said first and second end portions, wherein said first and second end portions form opposite, facing edges of said guide means and wherein said second upper end portion is moveably mounted for movement in a direction parallel to the paper path thereat to said first and second structural support means by means of which the curvature of the respective lateral end portions of said guide means may be independently adjusted in adjusting the paper path length between the respective ends of said rotatable paper drive means and said platen for precisely positioning the paper relative to said print head.

13. A paper feeding and guide apparatus for use in a line printer having a frame including first and second structural support means, a plurality of cross-members coupled between said first and second structural support means including a platen and a print head having a printing surface facing said platen and supported on a first cross-member and arranged to move in a path of travel along said first cross-member a permitted distance for printing on paper positioned between said platen and said print head and moving in a generally perpendicular direction to said print head direction of movement, said apparatus comprising:

rotatable paper drive means for receiving said paper following the transport of said paper between said platen and said print head and for transporting said paper in a plane generally perpendicular to the direction of movement of the paper between said platen and said print head, said rotatable paper drive means including a pair of separated drive sprockets each having a plurality of teeth located equidistant around its circumference for engaging a plurality of apertures located adjacent each lateral edge of said paper coupled to a rotatable drive shaft wherein the ends of said rotatable drive shafts are connected to each of said first and second structural support members; and semi-rigid, arcuate, adjustable guide means positioned beneath and in contact with said paper between said platen and said rotatable paper drive means and having a first lower end portion fixedly mounted to said first and second structural support means, a second upper end portion, and third and fourth lateral end portions positioned intermediate said first and second end portions, wherein said first and second end portions form opposite, facing edges of said guide means and wherein said second upper end portion is fixedly mounted to a second cross-member wherein the ends of said second cross-member are moveably connected for movement in a direction parallel to the paper path thereat to said first and second structural support means by means of bracket means in combination with threaded means such that when said threaded means are rotated the curvature of the respective lateral end portions of said guide means may be independently adjusted in adjusting the paper path length between the respective ends of said rotatable paper drive means and said platen for precisely positioning the paper relative to said print head.

* * * * *